United States Patent [19]

Ota et al.

[11] Patent Number: 4,639,291

[45] Date of Patent: Jan. 27, 1987

[54] METHOD OF CONTROLLING MOISTURE PROFILE IN PAPER WEB IN PAPER DRYING PROCESS AND APPARATUS PRACTICING SAME

[75] Inventors: Toyokazu Ota, Omihachiman; Yutaka Nakamura, Tomakomai; Yutaka Ikeda, Tomakomai; Shunzi Kataoka, Tomakomai; Yoshinobu Ito, Tomakomai, all of Japan

[73] Assignees: Shikishima Canvas Kabushiki Kaisha, Osaka; Oji Seishi Kabushiki Kaisha, Tokyo, both of Japan

[21] Appl. No.: 662,483

[22] Filed: Oct. 19, 1984

[51] Int. Cl.[4] ..... D21F 5/02

[52] U.S. Cl. ..... 162/207; 29/131; 29/132; 34/41; 34/110; 34/124; 162/359; 162/375; 165/89

[58] Field of Search ..... 29/110, 129.5, 131, 29/132; 34/41, 110, 124; 156/215; 100/93 RP; 162/359, 375, 207; 165/89

[56] References Cited

U.S. PATENT DOCUMENTS

| | | | |
|---|---|---|---|
| 508,595 | 11/1893 | Barrett | 29/131 |
| 2,264,731 | 12/1941 | Wakem | 29/131 |
| 3,276,140 | 10/1966 | Walser et al. | 34/110 |
| 4,192,080 | 3/1980 | Irpola | 29/110 |

FOREIGN PATENT DOCUMENTS

| | | | |
|---|---|---|---|
| 2000436 | 7/1971 | Fed. Rep. of Germany | 34/110 |

*Primary Examiner*—Peter Chin

*Attorney, Agent, or Firm*—Armstrong, Nikaido, Marmelstein & Kubovcik

[57] ABSTRACT

A drying cylinder for use in the drying part of a paper making process. The moisture profile of paper web is equalized all over the width of said paper web by fixedly winding synthetic fabric around the surface of a drying cylinder contacting with wet paper web at the appointed positions thereof to form the void areas among yarns of said synthetic fabric as highly insulating air-holding portions.

9 Claims, 7 Drawing Figures

METHOD OF CONTROLLING MOISTURE PROFILE IN PAPER WEB IN PAPER DRYING PROCESS AND APPARATUS PRACTICING SAME

BACKGROUND OF THE INVENTION

The present invention relates to a method of controlling the moisture profile in paper web in a paper drying process and an apparatus practicing same, and more particularly to an improvement of the drying part in a paper making process in which synthetic fabrics are fixedly wound around the appointed position of the surface of a drying cylinder to utilize the void areas among yarns of said synthetic fabrics as insulating air layers, wet paper web being dried through said insulating air layers whereby the moisture profile in said paper web is equalized all over said paper web.

A paper making machine provided with a multi-cylinder type drying mechanism has been used as an apparatus of making various kinds of paper material. Such a paper making machine is provided with a drying mechanism, which consists of several types of drying cylinders, in order to dry wet paper web continuously fed thereto through a web forming process and a pressing process. Although such drying cylinders are constructed in such a manner that steam is introduced thereinto and wet paper web is contacted with metallic cylinders, which are heated to the appointed temperature by the steam, through dryer felt to dry the wet paper web, in general the wet paper web is not even in the moisture profile, the moisture profile showing considerable fluctuations along the machine direction as well as the cross machine direction. On the other hand, since the width of drying cylinders is usually designed so that it may be larger than the width of paper web, there are remained the ranges, where the drying cylinders are not brought into contact with the wet paper web, at both end parts of a circumferential surface of the drying cylinders. Therefore, the surface temperature of the drying cylinders near both end parts of the circumferential surface thereof is apt to be higher than that in the region where the drying cylinders are brought into contact with the wet paper web. Thus, an edge portion of the wet paper web passing by the vicinity of both end parts of such drying cylinders is overdried due to its contact with the drying cylinders heated to temperatures higher than the appointed temperature. In the drying part, the wet paper web is dried not only by heat transmitted directly from the drying cylinders but also by the displacement of wet air to fresh dried air through the dryer felt in the pockets (a region defined by said felt and said wet paper web). That is to say, water evaporated from the wet paper web is discharged out of the pocket through the felt and dry air comes in the pocket from the outside thereof to promote the evaporation of water. This effect is called in general the natural ventilation effect of the drying pocket. The permeability of the dryer felt is designed so that the natural ventilation effect may be carried out in a well balanced condition. It was, however, unavoidable that the drying rate is apt to increase owing to the influences of cylinder end, an air current rising directly from the floor and the like, in the vicinity of the both end parts of the drying cylinders. In addition, the degree of overdrying is apt to fluctuate between the both end parts of the drying cylinders in general owing to the different constructions of the passages of heating medium formed in the drying cylinders. Although both end parts of wet paper web were very frequently overdried owing to the above mentioned various kinds of cause, sometimes for example the central part of wet paper web showed drying streaks according to circumstances, whereby various kinds of defect such as curling and others were produced to debase the quality of the final products. A large number of technical means have been practiced or proposed in order to obviate such troubles. For example, a method of controlling the quantity of water evaporated from wet paper web by adjusting the permeability of dryer felt in the cross machine direction thereof by means of the changes of weaving density, the treatment of an edge part with resins and the like whereby the volume of air coming in and going out of a pocket is changed; a method of reducing the surface temperature of both end parts of drying cylinders by changing the arrangement of steam supplying routes in said drying cylinders and opening drainage passages on the internal surfaces of both end parts of said drying cylinders; a method of adjusting temperature changes on the surface of drying cylinders by dividing the inside of said drying cylinders into a plurality of subdivision along the axial line thereof and providing steam supplying passages at different intervals in different subdivisions; various kinds of pocket ventilation apparatus and the like have been practiced or proposed. However, according to these means, it has been difficult to achieve the proper maintenance of an apparatus in spite of much cost and labour required for processing dryer felts or drying cylinders and the like. In addition, it has been difficult for these means to be promptly adapted as the moisture profile adjusting means for paper web of which moisture profile is changed time to time or in correspondence to the kind of the paper web to be dried.

Another method of preventing edge portions of a wet paper web from being overdried by adhering glass fiber cloths coated with fluorine resin to both end parts of the circumferential surface of drying cylinders to form an insulating layer also has been practiced in U.S. Pat. No. 4,192,080. However, according to this method, since the meshes of glass fiber cloths are substantially closed by fluorine resin coated on said glass fiber cloths as a coating agent and it is necessary to increase the thickness of resin layer coated on said glass fiber cloths to reinforce said glass fiber cloths owing to little resistance of glass fibers to abrasion, highly insulating air can not be held within said meshes and the above described function of preventing said edge portion from being overdried is remarkably spoiled.

SUMMARY OF THE INVENTION

It is a principal object of the present invention to provide a novel adjusting means for controlling the surface temperature of drying cylinders used in a paper drying machine and equalizing the moisture profile of a paper web in the cross machine direction.

It is another principal object of the present invention to provide a method of adjusting the moisture profile of a paper web in a paper drying machine and an apparatus for practicing same which can be promptly adapted to the changes of moisture profile of the paper web in the cross machine direction.

The present invention relates to a method of adjusting the moisture profile of paper web in a drying part for removing water from wet paper web in a paper making machine, in which synthetic fabrics are fixedly wound around the appointed positions of the surface of a drying cylinder, wet paper web being dried through air held in void areas among yarns of the synthetic fabric and drying cylinders used in the drying part. The point is a drying cylinder in which synthetic fabrics are fixedly wound around the surface contacting with wet paper web of the drying cylinder, the void areas among yarns of the synthetic fabric forming air holding portions.

PREFERRED EMBODIMENTS OF THE INVENTION

The present invention is detailedly described below with reference to the preferred embodiments in which synthetic woven fabrics are used as said synthetic fabric 2 and the meshes of said synthetic fabrics function as the void areas among yarns for holding air therein. But the point of the present invention is not limited by such preferred embodiments. Also, knit fabrics or non-woven cloths such as span bonded cloths can be used as said synthetic fabrics 2 in addition to woven fabrics. Accordingly, void areas among yarns 4 functioning as air holding portions include the meshes of woven or knit fabric and void areas formed by the intersection of fibers forming non-woven cloths.

Figure 1:
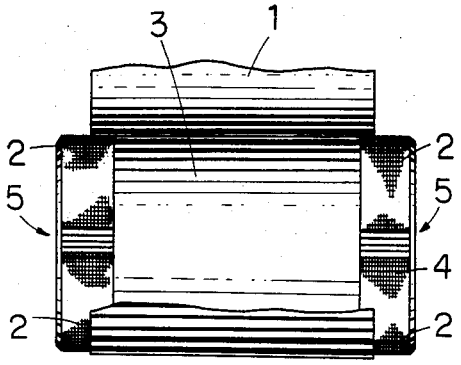
FIG. 1 is a front view showing a drying cylinder according to the present invention.
Figure 2:
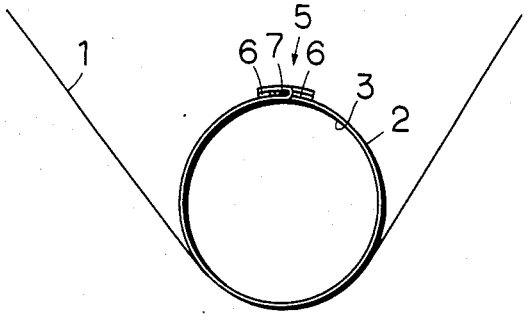
FIG. 2 is a side view showing a drying cylinder as shown in FIG. 1, FIGS. 3 (A), (B) are enlarged view showing a joint portion 5.
Figure 3A:
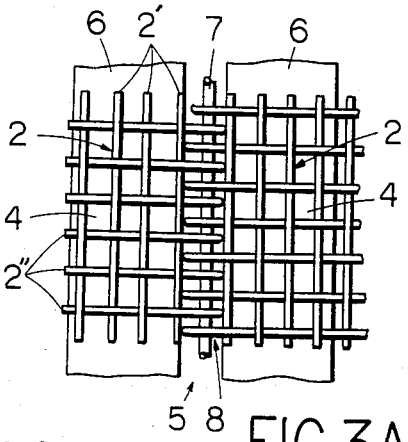
Figure 3B:
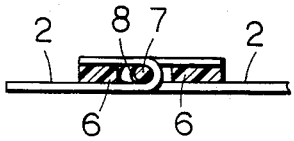

In the preferred embodiments as shown in FIGS. 1 to 6, a monofilament fabric 2 made of polyamide yarns, for example, nylon 66 by plain weaving (both warp and weft yarns having a diameter of 0.2 mm, both the density of warps and that of weft yarns being 40 ends/25.4 mm) is used as a member for forming an insulating air layer in both end parts of the circumferential surface of a drying cylinder. The monofilament fabric 2 made of nylon 66 is cut at a length slightly longer than the circumference of a drying cylinder 3, the fabric 2 being folded at the end portion thereof as shown in FIG. 2, an adhesive sheet 6 being inserted into between the folded portion and the base end portion of the fabric 2, and the fabric 2 being fusion bonded integrally to the adhesive sheet 6 by means of a bonding means such as a high-frequency welder. Then, several pieces of weft yarn 2' are pulled out of the folded portion to form loops 8 for jointing the fabric 2 at the end portions, the fabric 2 being wound around the drying cylinder 3 at the desired position of the circumference thereof, and the loops 8 being interdigitate side-by-side position to form the portions into which wire 7 is inserted. Subsequently, polyester monofilament yarn is inserted into the formed portions, as the wire 7 to form an endless wound layer of fabric on the surface of the drying cylinder 3, said drying cylinder 3 being heated under that condition to thermally shrink the fabric 2 whereby the fabric 2 is firmly fixed to the surface of the drying cylinder 3.

FIG. 1 shows a drying cylinder 3 for use in a multi-cylinder type drying machine which was fabricated according to the above mentioned method. Insulating regions, where the void areas 4 of the synthetic fabric 2 function as air-holding portions, are formed at both end portions of the circumferential surface of the drying cylinder 3. The surface area of the drying cylinder 3 to be covered with the synthetic fabric 2 is selected so as to meet the surface temperature distribution of the drying cylinder 3 and the moisture profile of a wet paper web 1 in the drying part. Since the overdrying phenomenon is mainly occurred at both end parts of the circumferential surface of the drying cylinder 3, in general the drying cylinder 3 is covered with the synthetic fabric 2 by the appointed width from both end surfaces thereof. However, the overdrying zones are occurred on the parts other than both end parts of the drying cylinder according to circumstances, when the overdrying zones also may be covered with the synthetic fabric 2. Thermally shrinkable synthetic resin monofilament yarns, for example, monofilaments of polyamides, polyesters, polytetrafluoroethylene, aromatic polyamides and the like are preferably used as the constituent element of synthetic fabrics. But also spun yarns, multi-filament yarns and the like may be used so far as they do not excessively increase the thickness of the synthetic fabrics 2. The diameter of yarns forming the synthetic fabrics 2 is preferably 0.1 to 0.3 mm for both warp and weft yarns in case of monofilament and the thickness of the synthetic fabric 2 is 0.5 mm or less, preferably 0.2 to 0.4 mm. If the thickness of the synthetic fabric 2 is extraordinarily reduced, the thickness of air-holding layers is reduced and it becomes difficult for the jointing portion 5 to be formed, whereby it becomes difficult for the synthetic fabric 2 to be mounted on the drying cylinder 3. Although plain weave fabric or twill weave fabric are generally used as the synthetic fabric 2, the former is preferably used in the present invention owing to the easy formation of the thin jointing portion 5, a large amount of air held in the meshes and the like. In case of plain weave fabric, numberless void areas surrounded by warps 2'' and weft yarns 2', for example the void areas 4 can function as air-holding portions by setting the density of both warp and weft yarns from 30 to 80 ends/25.4 mm. Although the void areas 4 functioning as the air-holding portions is dependent upon the construction, density and the like of the fabric 2, it is desired to be 30 to 60% based on the whole developed area of the fabric 2. The void areas 4 among yarns function as insulating layers having reduced heat conductivity, controlling the heat conductance from the surface of the drying cylinder 3 to the wet paper web 1, and effectively preventing an edge portion of the wet paper web 1 from being overdried. In the present invention, the void areas 4 among yarns make a thin layer of air function as an insulating layer, whereby the performance of preventing the overdrying phenomenon can be remarkably improved in comparison with the case where synthetic resin sheets having no such void areas among yarns. That is to say, since air is a non-heat-conductor having heat conductivity of 0.0264 Kcal/m.Hr.°C. (at 100° C.) to 0.0291 Kcal/m.Hr.°C. (at 150° C.) while polyester resins have heat conductivity of 0.198 Kcal/m.Hr.°C., polyamide resin having heat conductivity of 0.184 Kcal/m.Hr.°C., and polytetrafluoroethylene resin having heat conductivity of 0.21 Kcal/m.Hr.°C., such void areas 4 among yarns can exhibit an insulating effect about 10 times that in the case where a flat synthetic resin sheet having no meshes is used as an insulating material.

In the formation of the jointing portion 5, polyethylene resin sheets or polypropylene resin sheets may be used in place of the adhesive sheet 6. In addition, the folded portion may be sewn on the adhesive sheet 6 by means of sewing machine instead of a high-frequency welder. In cases where the jointing portion 5 is long, every several pieces of the loop 8 may be cut in a few places with suitable intervals to form "window", whereby making the insertion of wire 7 easy by utilizing the cut portions.

It is a circumference of the synthetic fabrics 2 that must be taken into consideration when the synthetic fabrics are fixedly wound around the surface of the drying cylinder 3. The synthetic fabrics 2 are fixedly adhered to the circumference of the drying cylinder 3 at the appointed positions thereof by being thermally shrunken by means of the suitable means, for example heating the drying cylinder 3, spraying of steam and the like after being placed on the surface of the drying cylinder 3. Consequently, it is necessary to select the length of the synthetic fabrics 2 slightly longer than the circumference of the drying cylinder 3 before they are placed on the drying cylinder 3. The rate of increasing the length is dependent upon the material of warps of the synthetic fabric. For example, in cases where polyamide resin or polyester resin are used as the material forming warps, the rate of shrinkage in steam of 100° C. is 7 to 9% for warps made of polyamide resin and 5 to 13% for warps made of polyester resin. It is, however, desirable that the rate of thermal shrinkage of fabric is preliminarily determined to calculate the design size prior to the use since the rate of shrinkage of fabric is considerably different from that of warps owing to a thermal hysteresis in the spinning process and heat setting temperatures after weaving. In this preferred embodiment, the synthetic fabric 2 can be completely adhered to the circumferential surface of the drying cylinder 3 owing to the thermal shrinkage thereof by adopting the design size selected counting on the thermal shrinkage of the synthetic fabric 2 so that the synthetic fabric 2 may not be separated from the drying cylinder 3 by the action of centrifugal force during high-speed revolution. It is desirable that the synthetic fabrics 2 are fusion bonded by means of an iron, of which edge portion in the longitudinal direction was heated, to prevent said synthetic fabrics 2 from being frayed before the synthetic fabrics 2 are wound around the drying cylinder 3.

Although, in the practice of the present invention, the surface size and positions of the drying cylinder 3 to be covered with the synthetic fabrics 2 are dependent upon the surface temperature of the drying cylinder 3 and the moisture profile of a wet paper web, in general the region from the end surface of the drying cylinder 3 from 0.2 to 1.0 m therefrom is selected as the region to be covered. Although it is desirable that the thickness of the synthetic fabric 2 is large as far as possible in order to increase the amount of air held in the void areas among yarns whereby improving an insulating effect, the construction of the synthetic fabric is selected so that the thickness of the synthetic fabric may be 0.20 to 0.40 mm since the formation of a great step portion owing to the thickness of the synthetic fabric 2 between the surface of the drying cylinder 3 and the surface of the region covered has a bad influence upon the quality of paper web.

Figure 4:
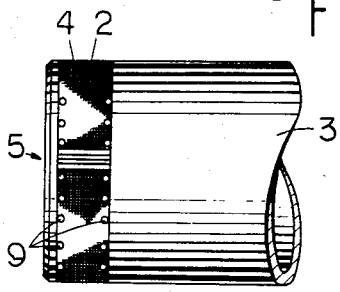
FIGS. 4 to 6 are front views showing preferred embodiments of a drying cylinder according to the present invention.
Figure 5:
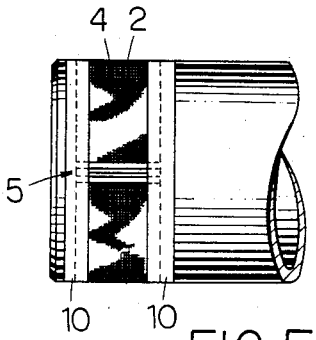
Figure 6:
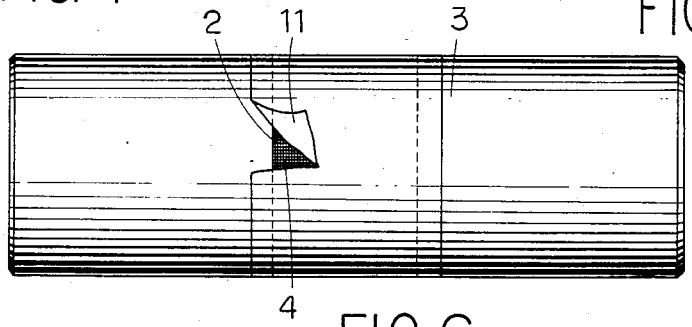

Although the preferred embodiment, in which the synthetic fabrics 2 are fixedly wound around the circumferential surface of the drying cylinder 3 by utilizing the jointing portion 5, was described above, the point of the present invention is not limited by such a preferred embodiment but can include the following preferred embodiments. As shown in FIG. 4, the second preferred embodiment shows a method in which said synthetic fabrics 2 having the jointing portion 5 are wound around the circumferential surface of the drying cylinder 3 at the desired positions thereof and an adhesive agent 9 is applied to edge portions of the synthetic fabrics 2 at the appointed interval. Although it is desirable that silicon resin type or epoxy resin type adhesive agents or adhesive agents containing heat resistant synthetic rubber as the main ingredient are used as the adhesive agent 9, the minimum amount thereof should be applied. As shown in FIG. 5, the third preferred embodiment shows a method in which the synthetic fabrics 2 having the jointing portion 5 are fixedly wound around the circumferential surface of the drying cylinder 3 at the desired positions thereof and then edge portions of the synthetic fabrics 2 are fixedly covered with a tape 10. The fourth preferred embodiment shows a method in which the synthetic fabrics 2 are wound around the circumferential surface of the drying cylinder 3 at the desired positions thereof and then edge portions of the synthetic fabric 2 are partially fixed by the use of an adhesive agent of a tape in the same manner as in the above described preferred embodiments followed by winding a fixing tape all around the circumference of edge portions to fixedly adhere the synthetic fabric 2 to the surface of the drying cylinder 3. In additional, the fifth preferred embodiment shows a method adopted in cases where the overdried portion is positioned in the vicinity of the central portion in the cross machine direction of the drying cylinder 3 differently from the above described preferred embodiments in which the synthetic fabrics 2 are wound around the circumferential surface of the drying cylinder 3 at the desired positions thereof and then the synthetic fabrics 2 are covered with a tape 11 all over the surface thereof to form the void areas 4 among yarns functioning as air-holding layers beneath the tape 11, as shown in FIG. 6. According to any one of these preferred embodiments, the void areas 4 among yarns of the synthetic fabric 2 can be formed as air-holding layers which suitably exhibit an insulating effect.

The preferred embodiment of the present invention, which was applied to the drying process of newsprints, is described below. In a multi-cylinder type drying machine comprising in all 53 pieces of drying cylinder 3, synthetic fiber fabrics 2 having jointing portions 5 are fixedly wound around 6 pieces of the drying cylinder selected from the 20-th to 30-th drying cylinders to form air-holding portions utilizing the void areas 4 among yarns on the circumferential surface of each drying cylinder. Thermal shrinkage of fabric by heating the drying cylinder was used for fixedly adhering the synthetic fabric 2 to the drying cylinder 3.

(1) The width of fabrics fixedly wound around the circumferential surface of a drying cylinder at both end portions thereof: 100 to 400 mm (2) The surface temperature of a drying cylinder: 120° C.

(3) The characteristics of synthetic fabric: the diameter of monofilaments forming nylon monofilament fabric, warp and weft yarns being 0.2 mm; both the density of warp and the density of weft yarns being 40 ends/25.4 mm; the thickness of fabric being 0.35 mm; the occupation rate of air-holding portions formed by the void areas among yarns being 47%.

The surface temperature of the drying cylinder at both end portions of the circumferential surface thereof measured after the appointed time since the start of the operation was lower than that before the synthetic fabrics are wound around the drying cylinder by about 10° C. In addition, the moisture profile of paper webs was almost uniform.

Synthetic fabric having the void areas among yarns functioning as air-holding portions can be wound around a drying cylinder within a short time during when the operation of a paper making machine is suspended without giving any special mechanical work or reconstruction to the drying cylinder. In addition, since the positions and the width of synthetic fabrics to be wound around the drying cylinder can be freely adjusted according to the changes in the temperature conditions of the drying process and the moisture profile of a paper web, highly insulating air-holding portions can be easily ensured even if the kind of paper webs to be made and the paper making conditions are changed.

What is claimed is:

1. A method for adjusting the moisture profile across the width of a wet paper web being fed longitudinally and wrapped partially around the dryer cylinder in the drying section of a papermaking machine characterized by contacting the wet paper web with the surface of a dryer cylinder, said surface having in a circumferential area around said cylinder where the moisture profile of said wet paper web is adjusted, a synthetic fabric having filaments extending longitudinally and filaments extending transversely of said cylinder in the direction of cylinder rotation, said longitudinally extending filaments and said transversely extending filaments, with said dryer cylinder surface, forming air filled heat insulting voids between the intersticies between said filaments and said wet paper web width contacting said synthetic fabric and feeding said wet paper web around said cylinder to dry said paper web and adjust the moisture profile thereacross.

2. A drying cylinder for use in the drying section of a paper making machine for adjusting the moisture profile across the width of a wet paper web dried thereby, said drying cylinder having an air impervious surface, characterized by a fabric of synthetic filaments extending longitudinally around and transversely across the surface of said cylinder in the area of said cylinder where the width of said paper web in which the moisture profile is to be adjusted contacts said drying cylinder, said synthetic filaments contacting said impervious surface and forming with said surface air filled heat insulating voids defined between intersticies of said filaments.

3. A drying cylinder as set forth in claim 2, in which said synthetic fabrics are formed of woven fabrics made of synthetic monofilament yarns.

4. A drying cylinder as set forth in claim 2, in which the ratio of the total area of said void between intersticies of said filaments of said fabric forming said air filled heat insulating voids to the whole developed area of said synthetic fabric is 30 to 60%.

5. A drying cylinder as set forth in claim 2, in which said synthetic fabric extending longitudinally around the surface of said drying cylinder are of woven fabric of synthetic monofilament yarns with the woven end portions of said fabric joined by loops of warps arranged in interdigitate side-by-side position with a wire inserted through said loops.

6. A drying cylinder as set forth in claims 5, in which the end portions of said fabric made of synthetic monofilament yarns are joined by said loops of warps and said wire and the longitudinal edge portions of said fabric are adhered to said cylinder at the appointed intervals by means of adhesive agents.

7. A drying cylinder as set forth in claim 5, in which the end portions of said fabric made of synthetic monofilament yarns are joined by said loops of warps and said wire and the longitudinal edge portions of said fabric are fixedly wound around the surface of said drying cylinder and fixed along the longitudinal length thereof by means of a fixing tape.

8. A drying cylinder as set forth in claim 2, in which said synthetic fabrics are wound around the circumferential surface of said drying cylinder and are covered over the surface thereof with fixing tape to form void areas between intersticies of said filaments and function as said air filled heat insulating voids on the underside of said fixing tape.

9. A drying cylinder as set forth in claims 5, in which said synthetic fabric has the thickness of 0.20 to 0.40 mm.

* * * * *